US009816700B1

(12) United States Patent
Gage

(10) Patent No.: US 9,816,700 B1
(45) Date of Patent: Nov. 14, 2017

(54) OIL CANDLE AND KIT THEREOF

(71) Applicant: Jed Gage, Wills Point, TX (US)

(72) Inventor: Jed Gage, Wills Point, TX (US)

( * ) Notice: Subject to any disclaimer, the term of this patent is extended or adjusted under 35 U.S.C. 154(b) by 518 days.

(21) Appl. No.: 14/188,534

(22) Filed: Feb. 24, 2014

Related U.S. Application Data

(60) Provisional application No. 61/768,147, filed on Feb. 22, 2013.

(51) Int. Cl.
*F23D 3/24* (2006.01)
*F23D 3/18* (2006.01)

(52) U.S. Cl.
CPC ..... *F23D 3/18* (2013.01)

(58) Field of Classification Search
CPC ..... F23D 3/02; F23D 3/16; F23D 3/18; F23D 3/24; F23D 3/28; F23D 3/34; F21V 37/0004; A61L 9/03; A61L 9/037
See application file for complete search history.

(56) References Cited

U.S. PATENT DOCUMENTS

D305,801 S 1/1990 Herb
D411,633 S 6/1999 Boss
2004/0085760 A1* 5/2004 Brizzie ..... F21V 37/00 362/161
2009/0291400 A1* 11/2009 Levy ..... A61L 9/037 431/120
2011/0097676 A1* 4/2011 Masterson ..... F23D 3/18 431/320

FOREIGN PATENT DOCUMENTS

BE 1006820 A6 * 12/1994 ..... F21V 37/00

OTHER PUBLICATIONS

NationalArtcraft.com; printout from webpage May 13, 2014.

* cited by examiner

*Primary Examiner* — Jason Lau
(74) *Attorney, Agent, or Firm* — Jack D. Stone, Jr.; Scheef & Stone, L.L.P.

(57) ABSTRACT

An oil candle includes a reservoir configured for holding flammable fluid. In one embodiment, the reservoir defines at an upper end thereof a funnel having a neck portion sized for receiving and supporting a wick, the wick being capable of extending through the neck of the funnel into the reservoir. In another embodiment, a lid rests on or over an upper end of the reservoir and a hole is defined through the lid for receiving and supporting a wick, the wick being capable of extending through the hole of the lid into the reservoir. A channel is preferably defined which encircles the hole, the channel being capable of retaining a scented oil.

24 Claims, 4 Drawing Sheets

OIL CANDLE AND KIT THEREOF

CROSS-REFERENCE TO RELATED APPLICATION

This application claims the benefit of U.S. Provisional Application No. 61/768,147, filed Feb. 22, 2013, which application is hereby incorporated herein by reference, in its entirety.

TECHNICAL FIELD

The invention relates generally to candles and, more particularly, to oil candles and kits for assembling same.

SUMMARY

The present invention provides an oil candle kit having a reservoir configured for holding flammable fluid.

In one embodiment of the oil candle kit, the reservoir defines a funnel at an upper end thereof. A wick holder is capable of resting on the funnel and defines a hole extending through the length of the holder for receiving and supporting a wick. A wick is capable of extending through the wick holder into the reservoir.

In another embodiment of the oil candle kit, the reservoir defines at an upper end thereof a funnel having a neck portion sized for receiving and supporting a wick, and a wick is capable of extending through the neck of the funnel into the reservoir.

In another embodiment of the oil candle kit, a lid rests on or over an upper end of the reservoir and a hole is defined through the lid for receiving and supporting a wick, and a wick is capable of extending through the hole of the lid into the reservoir. A channel is preferably defined in the lid, the channel encircling the hole and capable of holding a scented fluid, such as oil, effective for emitting a desirable fragrance. The channel may, alternatively, be defined in a separate element that fits over the lid.

In the foregoing, the oil candle kits may further include flammable fluid for placement in the reservoir.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 2:
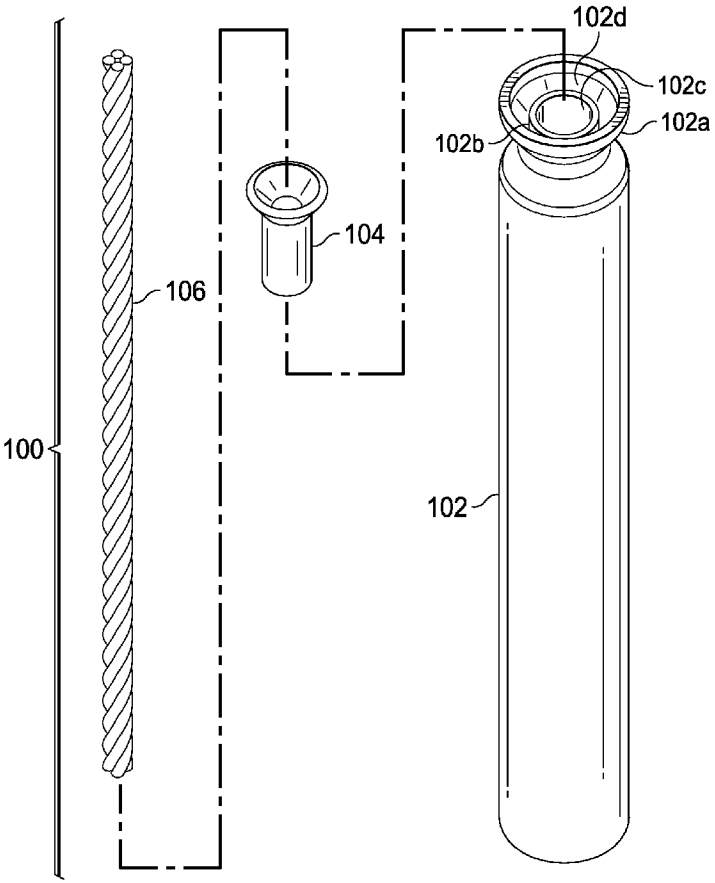
FIG. 2 is an exploded view of the invention of FIG. 1.

Refer now to the drawings wherein depicted elements are, for the sake of clarity, not necessarily shown to scale and wherein like or similar elements are designated by the same reference numeral through the several views. In the interest of conciseness, well-known elements may be illustrated in schematic or block diagram form in order not to obscure the present invention in unnecessary detail, and details concerning various other components known to the art, such as wicks, oil, and the like necessary for the operation of oil candles, have not been shown or discussed in detail inasmuch as such details are not considered necessary to obtain a complete understanding of the present invention, and are considered to be within the skills of persons of ordinary skill in the relevant art.

Figure 1:
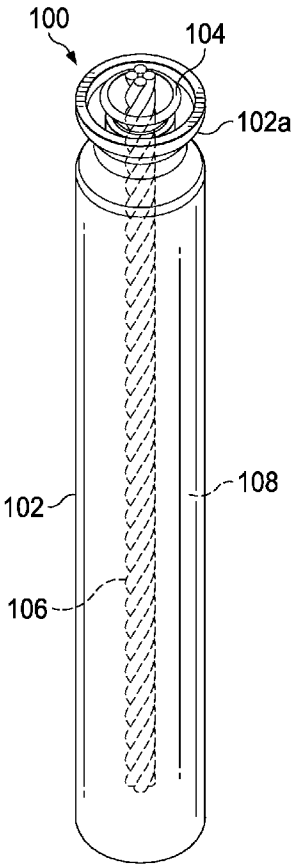
FIG. 1 is a schematic diagram exemplifying one preferred embodiment of the invention.

Referring to FIG. 1 of the drawings, the reference numeral 100 generally designates an oil candle embodying features of the present invention, and FIG. 2 depicts an assembly of parts of the oil candle 100 preferably constituting the oil candle as a kit. The oil candle 100 includes a reservoir 102 defining a funnel 102*a* at an upper end thereof. The funnel 102*a* preferably includes a neck 102*b* through which is defined a hole 102*c* and around which is defined a channel 102*d* substantially in the shape of a toroidal structure. The channel 102*d* is capable of holding, and is configured for supporting, a scented fluid, such as oil, effective for emitting a desirable fragrance when warmed by a flame of the wick 106. Below the funnel 102*a*, the reservoir is preferably cylindrically shaped, but may assume any shape suitable for holding flammable liquid 108, such as oil. A wick holder 104 is positioned in the funnel 102*a*, wherein the holder defines a hole extending through the length of the holder, the hole being sized for receiving a wick 106, the wick 106 being positioned within and supported by the holder 104. The wick 106 is fabricated from material effective for wicking flammable fluid 108 upwardly therein, and the top of the wick 106 is preferably even with, or optionally extending above, the top of the holder 104.

As a kit, the wick 106 is preferably inserted into the holder 104 so that the top of the wick is preferably even with, or optionally slightly above, the top of the holder. The holder 104, with the wick 106 inserted therein, is then inserted into the funnel 102*a*, and is supported by the funnel 102*a*.

Figure 8:
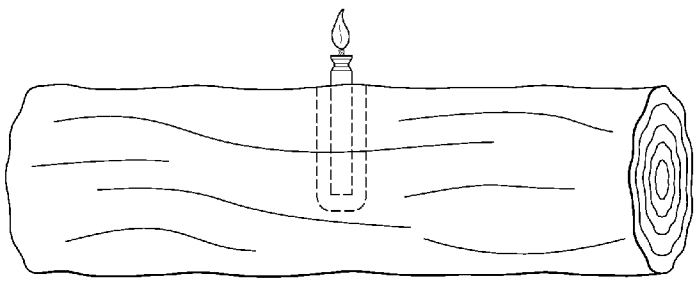
FIGS. 7-10 exemplify various support structures of the invention.
Figure 10:
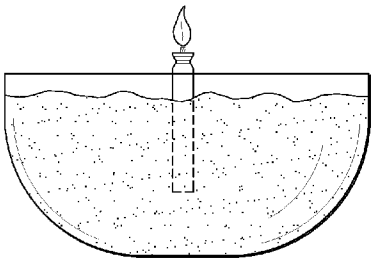
Figure 7:
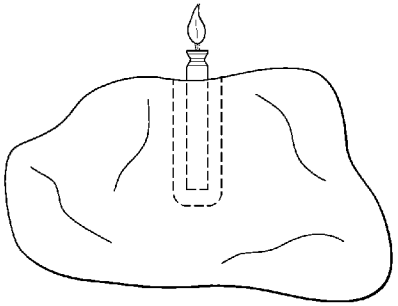
Figure 9:
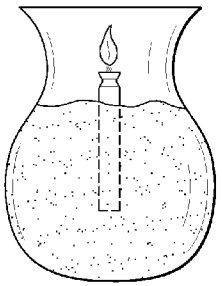

In operation, a flammable fluid 108, such as oil, is poured into the reservoir 102 prior to insertion of the holder 104 into the funnel 102*a*. The holder 104, with the wick 106 inserted therein, is then inserted into the funnel 102*a*. The oil candle 100 is, optionally, then inserted into a support structure configured for holding the oil candle 100 in an upright position, such as a bottle, or a stone 700 (FIG. 7) or log 800 (FIG. 8) with an opening or hole (702, 802, FIG. 7, 8) drilled, or otherwise formed, in it. Alternatively, a support structure such as a vase 900 (FIG. 9) or pot 1000 (FIG. 10) may define an interior filled with material such as beads, sand, gravel, Styrofoam®, or the like, effective for holding the oil candle 100 in an upright position. Scented oil may optionally be poured into the channel 102*d*. As the flammable fluid 108 is wicked upwardly in the wick 106, the wick may then be lit with a flame, such as from a match, and the flame sustained until the oil is used up or the flame extinguished. If the channel 102*d* includes scented oil, heat from the flame should create a fragrance in the surrounding air.

Figure 4:
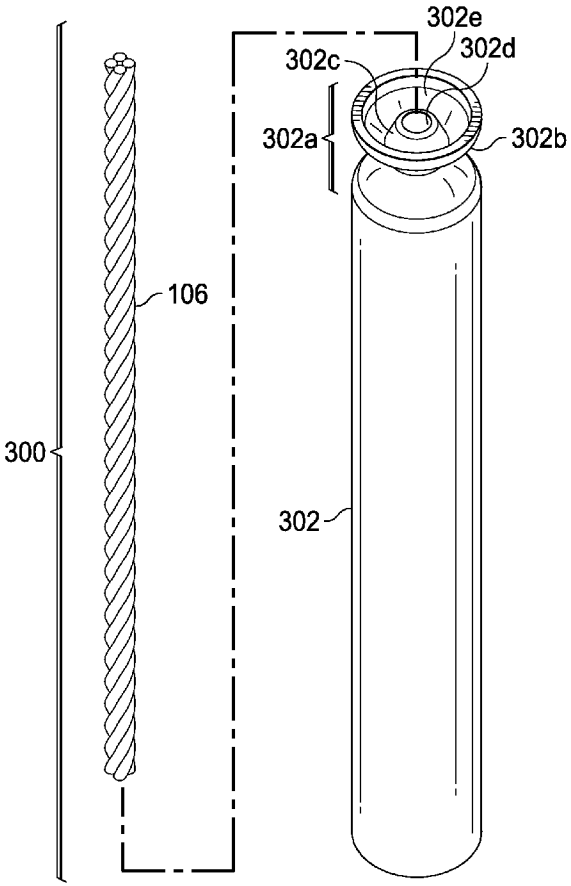
FIG. 4 is an exploded view of the embodiment of FIG. 3.
Figure 3:
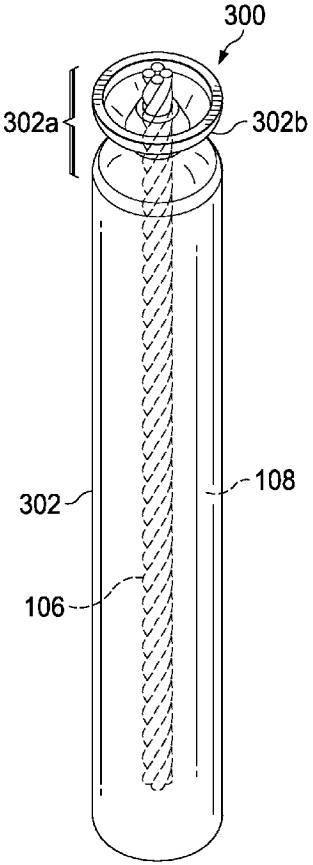
FIG. 3 is a schematic diagram exemplifying an alternate preferred embodiment of the invention.

FIG. 3 exemplifies an alternate preferred embodiment of the oil candle, designated by the reference numeral 300, and FIG. 4 depicts the assembly of parts of the oil candle 300 preferably constituting the oil candle as a kit. The oil candle 300 is similar to the oil candle 100, but for the reservoir, designated by the reference numeral 302 defining a funnel 302*a* having a more restricted neck 302*b* than the funnel 102*a*. More specifically, the neck 302*b* is sized to approximate the size of the wick holder 104 so that the wick 106 may be inserted into and supported by the funnel 302*a* and neck 302*b*, thereby rendering unnecessary the need for the wick holder 104. The funnel 302*a* preferably includes an interior neck 302*c* through which is defined a hole 302*d* and around which is defined a channel 302*e*. The channel 302*e* is capable of holding a scented fluid, such as oil, effective for emitting a desirable fragrance when warmed by a flame of the wick 106. Assembly of the kit depicted by FIG. 4 and operation of the oil candle is otherwise similar to that of the oil candle 100 discussed above with respect to FIGS. 1 and 2.

Figure 6:
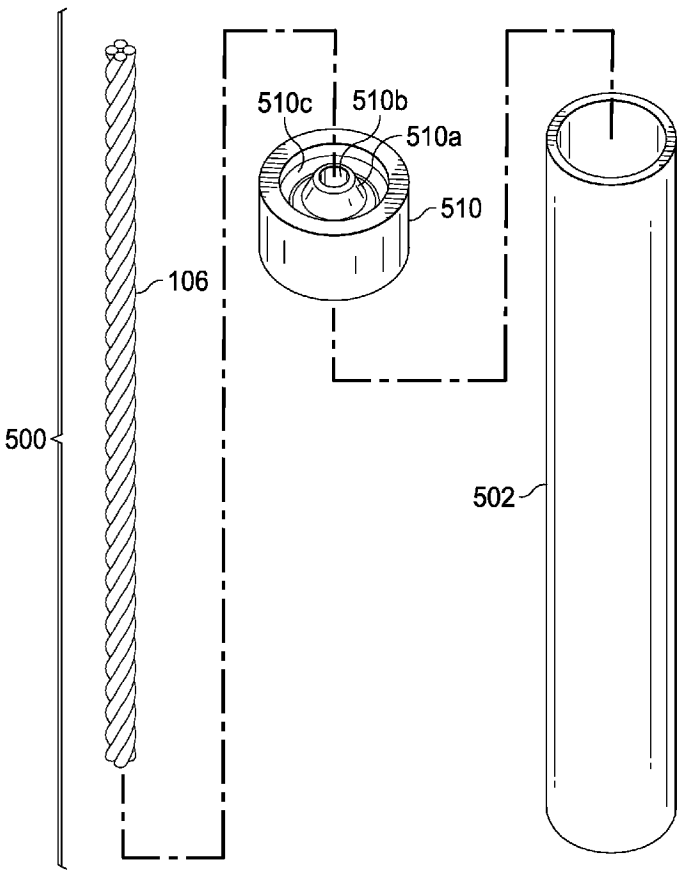
FIG. 6 is an exploded view of the embodiment of FIG. 5.
Figure 5:
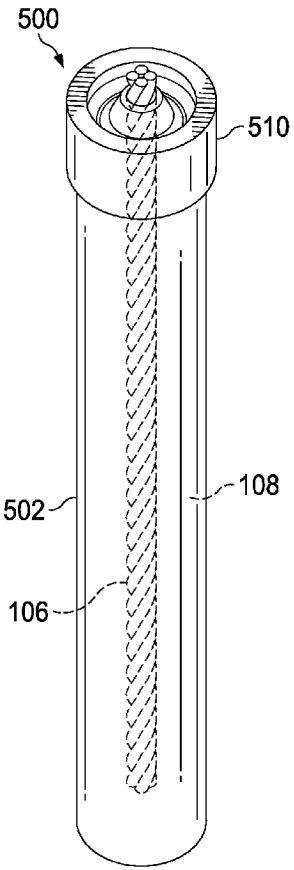
FIG. 5 is a schematic diagram exemplifying a second alternate preferred embodiment of the invention.

FIG. 5 exemplifies a second alternate preferred embodiment of the oil candle, designated by the reference numeral 500, and FIG. 6 depicts the assembly of parts of the oil candle 500 constituting the oil candle as a kit. The oil candle 500 is similar to the oil candles 100 and 300, but for the reservoir, designated by the reference numeral 502, which preferably defines a generally straight upper portion with no funnel 102*a* or 302*a*. Rather the funnel 102*a* or 302*a* is replaced with a lid 510 which is positioned like a cap on top of the reservoir 502. The lid 510 preferably includes a neck 510*a* through which a hole 510*b* is defined, the hole being suitably sized to receive and support the wick 106, thereby rendering unnecessary the need for the wick holder 104/302*b* or funnel 102*a*/302*a*. A recessed channel 510*c* is preferably also defined in the lid 510, the channel 510*c* encircling the hole 510*b* and capable of holding a scented fluid, such as oil, effective for emitting a desirable fragrance when warmed by a flame of the wick 106. The channel 510*c* may, alternatively, be defined in a separate element (not shown) that fits over the lid.

As a kit, the wick 106 is inserted through the hole 510*b* of the lid 510 so that the top of the wick is preferably even with, or optionally slightly above, the top of the lid. The lid 510, with the wick 106 inserted therein, is then positioned on top of the reservoir 502. In operation, a flammable fluid 108, such as oil, is poured into the reservoir 502. The wick 106 is inserted through the hole 510*b* of the lid 510, and the lid is positioned on top of the reservoir 502. A scented oil is, optionally, poured into the channel 510*c*. The oil candle 500 is, optionally, inserted into a support structure configured for holding the oil candle 100 in an upright position, such support structure as a bottle, or a stone 700 (FIG. 7) or log 800 (FIG. 8) with an opening or hole (702, 802, FIG. 7, 8) drilled, or otherwise formed, in it. Alternatively, a support structure, such as a vase (900, FIG. 9) or pot (1000, FIG. 10) defining an interior filled with material (902, 1002, FIG. 9 or 10), such as sand, gravel, Styrofoam®, beads, or the like, may be utilized for holding the oil candle 500 in an upright position. Flammable fluid 108 wicks upwardly in the wick 106, whereupon the wick may then be lit with a flame, such as from a match, and the flame sustained until the oil is used up or the flame extinguished.

It is understood that the present invention may take many forms and embodiments. Accordingly, several variations may be made in the foregoing without departing from the spirit or the scope of the invention. For example, the wick holder 104 of the oil candle 100 may be configured to have a channel similar to the channel 102*d* for serving as a scented oil warmer whereby the channel is filled with scented oil prior to lighting the wick. The wick 106 may be made from a material that also uses catalytic combustion that diffuses aromatic oil. The reservoir 102, 302, or 502 may assume any shape suitable for holding liquid 108, with constant diameter, variable diameter, and/or variable height.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. An oil candle kit comprising:

a reservoir defining a space configured for holding flammable fluid, the reservoir defining a funnel at an upper end thereof, the funnel defining a neck portion sized for receiving and supporting a wick and a channel, the channel being a substantially toroidal structure external of the space and configured for supporting a scented oil separately from the flammable fluid; and a wick capable of extending through the neck of the funnel into the reservoir.

2. The oil candle kit of claim 1, further comprising flammable fluid for placement in the reservoir.

3. An oil candle kit comprising:

a reservoir configured for holding flammable fluid;

a lid capable of resting on an upper end of the reservoir and defining a hole through the lid for receiving and supporting a wick;

a channel defined as a substantially toroidal structure in the lid, the channel being adjacent the hole and configured for supporting a scented oil separately from the flammable fluid; and a wick capable of extending through the hole of the lid into the reservoir.

4. The oil candle kit of claim 3, further comprising flammable fluid for placement in the reservoir.

5. The oil candle kit of claim 3, wherein the reservoir defines a space for holding the flammable fluid and the channel is external of the space defined by the reservoir.

6. The oil candle kit of claim 3, wherein the channel substantially encircles the hole.

7. The oil candle kit of claim 3, further comprising a support structure defining an opening for receiving and supporting the reservoir.

8. The oil candle kit of claim 3, further comprising a support structure defining an opening for receiving and supporting the reservoir, the support structure having the appearance of a log.

9. The oil candle kit of claim 3, further comprising a support structure defining an opening for receiving and supporting the reservoir, the support structure having the appearance of a stone.

10. The oil candle kit of claim 3, further comprising a vase defining an opening capable of retaining material capable of receiving and supporting the reservoir.

11. The oil candle kit of claim 5, further comprising a pot defining an opening capable of retaining material capable of receiving and supporting the reservoir.

12. The oil candle kit of claim 3, further comprising a vase defining an opening capable of retaining material capable of receiving and supporting the reservoir, the material being at least one of beads, gravel, sand, and polystyrene foam.

13. An oil candle comprising:

a reservoir defining a space configured for holding flammable fluid, the reservoir defining a funnel at an upper end thereof, the funnel defining a neck portion sized for receiving and supporting a wick and a channel, the channel being a substantially toroidal structure external of the space and configured for supporting a scented oil separately from the flammable fluid; and a wick extending through the neck of the funnel into the flammable fluid in the reservoir.

14. The oil candle of claim 13, further comprising flammable fluid in the reservoir.

15. An oil candle comprising:

a reservoir configured for holding flammable fluid;

a lid resting on or over an upper end of the reservoir and defining a hole for receiving and supporting a wick;

a channel defined as a substantially toroidal structure in the lid, the channel being adjacent the hole and being configured for supporting a scented oil separately from the flammable fluid; and a wick extending through the hole of the lid into the flammable fluid in the reservoir.

16. The oil candle of claim 15, further comprising flammable fluid in the reservoir.

17. The oil candle of claim 15, wherein the reservoir defines a space for holding the flammable fluid and the channel is external of the space defined by the reservoir.

18. The oil candle of claim 15, wherein the channel substantially encircles the hole.

19. The oil candle of claim 15, further comprising a support structure defining an opening for receiving and supporting the reservoir.

20. The oil candle of claim 15, further comprising a support structure defining an opening for receiving and supporting the reservoir, the support structure having the appearance of a log.

21. The oil candle of claim 15, further comprising a support structure defining an opening for receiving and supporting the reservoir, the support structure having the appearance of a stone.

22. The oil candle of claim 15, further comprising a vase defining an opening capable of retaining material capable of receiving and supporting the reservoir.

23. The oil candle of claim 15, further comprising a pot defining an opening capable of retaining material capable of receiving and supporting the reservoir.

24. The oil candle of claim 15, further comprising a vase defining an opening capable of retaining material capable of receiving and supporting the reservoir, the material being at least one of beads, gravel, sand, and polystyrene foam.

* * * * *